United States Patent [19]

Fangmeier et al.

[11] 3,933,018

[45] Jan. 20, 1976

[54] METHOD AND APPARATUS FOR STRAIGHTENING END SECTIONS OF ELONGATED WORKPIECES

[75] Inventors: Ralf Fangmeier; Carl-Ludwig Pohler, both of Solingen, Germany

[73] Assignee: Th. Kieserling & Albrecht, Solingen, Germany

[22] Filed: Oct. 3, 1974

[21] Appl. No.: 511,639

[30] Foreign Application Priority Data

Oct. 3, 1973 Germany ..... 2349693

[52] U.S. Cl. ..... 72/7; 72/14; 72/99

[51] Int. Cl.[2] ..... B21D 3/04

[58] Field of Search ..... 72/7, 14, 95, 98, 99, 100

[56] References Cited

UNITED STATES PATENTS 2,271,783 2/1942 Sutton ..... 72/99

FOREIGN PATENTS OR APPLICATIONS 1,939,778 2/1971 Germany ..... 72/14

*Primary Examiner*—Lowell A. Larson

*Attorney, Agent, or Firm*—Edward E. Sachs

[57] ABSTRACT

A method and an apparatus for carrying out the method for straightening sections of elongated workpieces such as bars and tubes in a bending, forging and/or straightening machine having at least one straightening roll which can be moved radially relative to the workpiece and at least a second roll for determining the straightening gap end face. During the initial and end phase of the straightening process the head and tail sections of the workpiece, respectively, are affected by a roll which moves in accordance with a preselected mathematical function or sequence.

13 Claims, 7 Drawing Figures

1
2
3
4
6
7
7a
8
9
10
11
12
13
14
M
P
NR
17
18
18a
19
19b
20
21

1
2
3
4
6
7
7a
8
9
10
11
12
21
21a
22
23
24
61
M
P
NR
V
I
U
t
0

METHOD AND APPARATUS FOR STRAIGHTENING END SECTIONS OF ELONGATED WORKPIECES

The invention relates to a method and apparatus for straightening elongated material such as bars or tubes, in a bending-and/or forging-straightening machine, wherein the straightening gap is altered during the straightening operation by radial adjustment of at least one straightening roll.

Deformation of the front and tail sections of elongated workpieces occurs quite regularly when such workpieces are bent. Particularly, forge-straightening, on a two-roll straightening machine, is disadvantageous because it results in workpieces having ends which do not satisfy tolerance requirements. For this reason, these ends, which are approximately on the order of 100 mm in length, are often unusable. The present invention is primarily directed to improving two-roll straightening machines. With constantly increasing demands for dimensional stability and accuracy in straightening, this problem is becoming increasingly more important. It is especially noteworthy that accuracy in straightening and dimensional stability have trended in opposite directions, i.e., neither presents a problem per se, but the combination of the two has hitherto been unattainable. It is also to be noted that the phenomena of deformed ends may exceed tolerance limitations in either direction.

The tail end of a bar or tube is formed with a conical section the diameter of which increases towards the middle section of the bar. This conical section may be slightly curved, concave or convex, in such a manner that this section projects downwardly from acceptable tolerance field, whereas the next adjacent section of the workpiece may have a similarity to a spherical zone and project upwardly from the tolerance field.

Various methods are known for straightening workpieces which rotate about their longitudinal axes, in which the straightening force may be varied during the straightening operation. For example, German Patent Publication DOS No. 1,752,406 describes a straightening machine and a method which can be carried out by the machine, in which the straightening force is controlled in direct relation to the straightening operation. However, the teaching in the German Publication specifically defeats the shortcomings which the present invention obviates. The German Publication states that the "control can become effective only when the entire length of the machine is occupied by the workpiece", see page 6, lines 13–15. However, the lack of positive control over the end pieces and deformation resulting therefrom arises during that portion of the straightening operation when, according to the said German disclosure, the workpiece has passed the first regulating device (12) but has not yet reached the second regulating device (13).

Another machine that has been suggested (see German Utility Patent No. 1,996,031) pre-loads the "frame of the machine", in order that non-circular material can also enter the enlarged straightening gap. This prevents that the edge of the end face of the out of round workpiece against the straightening rolls, which are held in spring bias and therefore the workpiece first has to push the rolls apart against the increasing, periodically surging, straightening force which reaches its rated value as the straightening gap widens. The prior art does not however resolve the problem obviated by the invention, nor does the prior art teach ways and means to provide a solution.

It is the primary object of the present invention to provide a method and an apparatus for carrying out the method which makes it possible to manufacture sections of elongated materials in which the tolerances for diameter and straightening accuracy are maintained over the entire length of the workpiece and, more particularly, to maintain the end segments of the bars or tubes within the predetermined tolerances, while retaining surface quality.

In accordance with one aspect of the present invention the object is achieved by providing that during the inlet and outlet phase of each elongated workpiece, at least one of the straightening rollers for the bending and/or forging the forward or tail end segment is advanced or withdrawn in accordance with a pre-selectable mathematically expressed sequence function. This makes it possible to control and adapt the straightening force to respond to various factors related to the characteristics of the workpiece, such as hardness, elastic limit, diameter, and the required bending. Similarly, the straightening force can be increased or decreased to take into account mechanical factors, such as the arrangement and configuration of the rolls and the rotational velocity thereof. Between the inlet and outlet phases the straightening force is constant. The controlled application of the straightening force ensures that the edge of the end face, at the inlet end of the workpiece, remains almost in its original shape, thus is without any detrimental deformation. This method avoids the conical end section and eliminates the danger of the conical end section of the workpiece exceeding the tolerance limitations. It also facilitates the displacement of the average diameter in the tolerance field towards the lower tolerance limits, which the conical section now no longer reaches, so that the subsequent barrel-shaped convex area, depending upon the width of the tolerance field, can also be shifted completely into the tolerance range. In addition, in the absence of squeezing the forward end face, the front section of the barrel-shaped convex segment is also less affected. Depending upon the relationship between the tolerance range and the deformation of the end sections, either the average diameter range can be lowered in the tolerance field so that it approaches the lower tolerance limit, or the tolerance range can be narrowed by this shifting of the average diameter.

In the event that the desired tolerance still cannot be maintained, another aspect of the present invention provides that, in the case of a forging-straightening machine with means for adjusting the bend, the adjustment for bending takes place independently of the adjustment of the forging, and is carried out during the straightening operation. There are various ways of adjusting the bend and forging. In the case of conventional two-roll rolling mills, separate control for forging and bending may be achieved by adjusting for forging the entire hyperbolic roll carrier radially of the workpiece, whereas adjustment for bending is carried out by rotating the other roll carrier and roll when the workpiece enters the machine, i.e., when the straightening operation is already in progress. Where the straightening rolls are arranged above the other, it is preferable to rotate the hyperbolic upper roll.

Another way of controlling the bending independently of the forging is to sub-divide the hyperbolic roll.

A three-piece hyperbolic upper roll is provided, in which the two outer members — each with one apex of the bending triangle at the points of contact with the workpiece — may be lowered at a preselectably variable speed, thus increasing or decreasing the bending in the workpiece.

The purpose of altering the bending while the workpiece is entering the machine is to ensure plastic bending of the first and last sections of the workpiece. This is achieved by applying permissible surface-pressure values to the end face edge of one of the two outer ends of the workpiece. During this operation, the polishing or forging effect is to be maintained over the whole section of the elongated workpiece.

Whereas free bending produces a change in diameter (see "Stahl und Eisen" 1962, pages 836/46 and "Stahl und Eisen" 1968, pages 1027/36, especially page 1029), and the deformation of the workpiece in a two-roll straightening machine, after it leaves the forging zone, is comparable to free bending, the bulge adjacent the cone is attributed to particularly sharp bending in the first and last sections of the workpiece. However, against a constant, theoretically ideal bend over the entire workpiece one must consider the fact that, because of the short lever arm, bending the first very short section as it leaves the forging area, requires very high pressure in order to impart thereto the desired bending load. Thus the objective of a uniform bending load over the entire length of the workpiece causes difficulties in principle, and is in contradiction to the excessively high pressure, also arising in practice, on the first section of the workpiece leaving the forging area. The cause of this very high pressure is related to the deformation of the end section.

Therefore, another aspect of the present invention provides that, in a two-roll straightening machine, not only the forging force but also the bending force is applied in accordance with a mathematical function, reaching their full value only when the beginning of the workpiece has already left the bending triangle, i.e., when the inlet phase has ended. The bending and forging forces are therefore decreased at the end of the workpiece. This harmonious application of the forging force, and the subsequent application of the bending force, also results in high surface quality at the ends of the workpiece, since the forging operation is carried out over the whole of the workpiece while, over a minimal end section, the workpiece is not straightened. This section, however, bears no relationship to the end portion left unstraightened in a three-roll straightening machine. Herein the end section amounts to less than one-half the length of the hyperbolic roll. Moreover, the significance of such a very short unstraightened section, or rather of a section not straightened with the full bending, is very slight, since the deviation of the centerline of the workpiece from the ideal straight line has very little effect, inasmuch as the potentially curved section would be very short.

In a still further aspect of the invention, provision is made for controlling the straightening force in relation to the time required for the end portion of the workpieces (i.e., either forward or rear) to travel over the distance between a signal station (e.g. a light barrier, an induction coil, etc.) and the subsequent straightening station, and at a given straightening speed. This approach has been found advantageous since it operates without contact sensors and is time-wise also sufficiently accurate. The required control devices are mass-produced electromechanical or electronic components and are therefore more economical than mechanical components which have to be specifically adapted to the system.

According to another aspect of the present invention, the straightening force in free bending reaches its maximum rated value only when the bending triangle has assumed its final configuration. Thus for example, when the workpiece enters the machine, this final configuration of the bending triangle occurs as soon as the initial segment of the bar, and more particularly the annular edge of the end face of the bar, no longer forms the third point of contact with the straightening roll, but rather with its peripheral surface. As long as the edge of the end face forms the third point of contact with the straightening roll, it moves with the edge on the straightening roll into its final position. The bending triangle assumes its final configuration only when the first section of the workpiece leaves the straightening roll.

In one embodiment of the invention, there is provided that the forging force is controlled in such a manner that the surface pressure on the end sections of the workpiece when compressed and varied in length as it enters and leaves the machine, always remains constant. As a result, the first section of the workpiece entering the forging area need not absorb the same force as a section occupying the entire forging area. Instead, the forging force increases or decreases proportionally with the length of the portion of the workpiece in the forging region.

In view of the foregoing, the function is a linear time-dependent function, or an e-function approximating that function. Although in principle a linear function achieves the desired effect, it, however, is inferior to a closely approximating e-function, which results from the rotation of for instance the tie-rod of the straightening machine because, in the case of an e-function it is not essential to maintain the starting time exactly since the increase in the e-function at that moment is less. An e-function, therefore, provides greater leeway for the time of applying the straightening force.

For free bending it has been found advantageous to design the function in the form of an inclined sine line. This configuration is adequately known from mechanics especially kinematics. It provides particularly favorable acceleration conditions, avoiding impact and irregular or sudden advance and withdrawal of the rolls.

The straightening machine is characterized by an electronic control system for at least one straightening roll for each group of rolls pre-selectable characteristics for increasing and decreasing the straightening force. Electronic control is preferred to mechanical control for economic reasons, size, and weight. It also makes possible the rapid interchange of individual components (plug-in cards), for adapting the special inlet function to other required conditions and to enable various kinds of material to be straightened in one machine. This ensures that the interchangeable cards, which may also be used by unskilled labor if adequately identified, do not cause the electronic control to reduce the possible number of ways in which the machine may be used.

A still further aspect of the present invention resides in combining a hydraulic overload protector with means for transferring the control signals. Herein, the electronic control system is connected to straightening-force limiting valve. This eliminates the need for additional means for adjusting the controllable straightening roll. The hydraulic safety devices which are usually available can also be used to control the inlet and outlet phase of the workpiece.

In order to provide separate mechanical control over the forging and bending operation of a two-roll straightening machine, the machine comprises one hyperbolic and one cylindrical straightening roll, so that at least the hyperbolic roll is mounted to rotate, during the straightening operation, about an axis at right angles to the workpiece and to the longitudinal axis of the hyperbolic roll. The longitudinal axis of the hyperbolic roll can be adjusted in relation to the workpiece during the straightening operation, i.e., under load, which makes it possible to increase or decrease the bending at the beginning or end of the workpiece smoothly, and thus avoid causing the ends to be conically enlarged by varied bending stresses and by crushing of the end section. A relatively unimportant disadvantage does occur in that a small section at the beginning and end of each workpiece is not completely straightened.

For a better understanding of the present invention, together with other and further objects thereof, reference is had to the following description taken in connection with the accompanying drawings, and its scope will be pointed out in the appended claims.

Figures 1, 2:
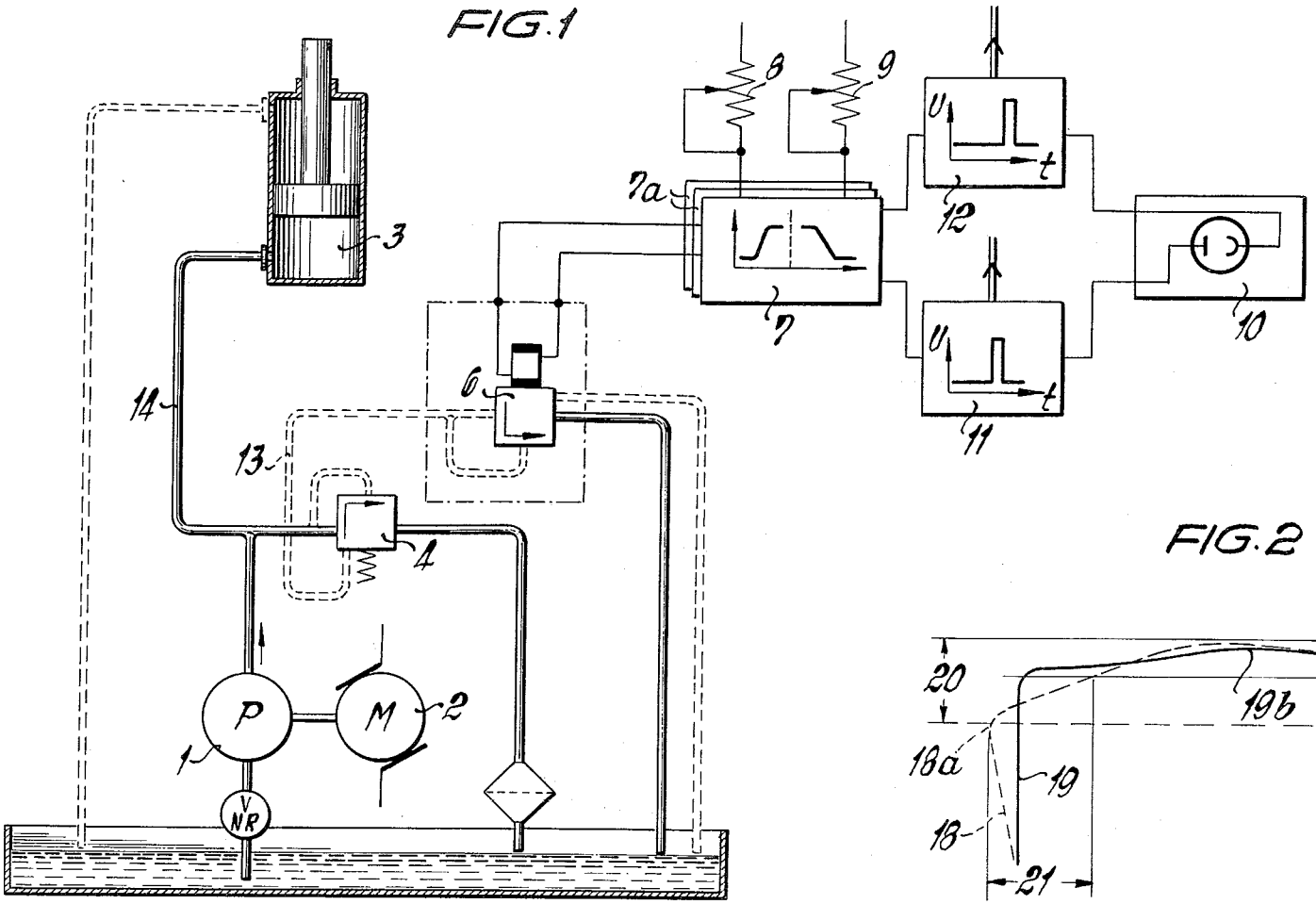
FIG. 1 is a diagrammatic illustration of the circuit in accordance with the present invention.
FIG. 2 shows a peripheral segment of a straightened bar end.

Referring now to the drawings, there is shown in FIG. 1 a pump 1, driven by an electric motor 2, to establish pressure in a cylinder 3. A pre-set safety valve limits excessive straightening-forces to protect a machine 5 (see FIG. 6), which houses hydraulic cylinder 3, against overload. A remote-controlled pressure-limit valve 6 transfers the electrical signals, which vary in current intensity, from electronic function or sequence transmitter 7 to straightening-force-limit valve 4. Adjustable potentiometers 8 and 9 allow the values for determining the straightening-speed and maximal-straightening-force to flow into the sequency function-transmitter 7 whereby the pressure in line 14 is controlled.

The signal for applying the straightening force, which is released by a signal generator 10 in the form of a coil or a light barrier, is delayed by time switches 11, 12 according to the quotient of the path between the signal generator and the straightening rolls, and straightening speed. Various delays may be provided for the inlet and outlet, hence there are provided two time switches. Moreover, the straightening force may be increased and decreased to facilitate different operational sequences (functions), as indicated in the electronic function transmitter. The number of possibilities may be increased by means of interchangeable function transmitter 7*a*. The potentiometer 8 feeds in the straightening speed by means of which the function or operational sequence in electronic function-transmitter 7 is stretched or contracted in the direction of the abscissa. The same stretching or contraction is produced by potentiometer 9 which determines the maximal current intensity (max. straightening force) in the direction of the ordinate.

The remote-controlled pressure-limiting valve 6 converts the current signals from the electronic function-transmitter 7 into analoguous pressure fluctuations in line 13. The line 13 acts as a control line for pre-selectable pressure-limiting valve 4. Thus the pressure in line 14 and in cylinder 3 is increased or reduced in accordance with a pre-selectable mathematical expression or function. In addition to the adjustability of the operational sequence (function) in the electronic function-transmitter, which is preferably in the form of a linear function, or a closely approximating e-function, workpiece characteristics and other mechanical factors may be taken into account. The time required for starting and ending the workpiece travel between the distance of signal station 10 and subsequent straightening rolls 15, 16, at a given straightening speed, may be adjusted by means of time-switches 11, 12.

As electronic control system is provided for at least one straightening roll for each group of straightening rolls. It is conventional to provide more than one group of rolls in machines of this nature.

Referring now to FIG. 2 there is shown the contour of a workpiece 19 after it has been forged by a controlled force and contour of workpiece 18 subsequent to a conventional straightening step. The potential tolerance field 17, for the workpiece according to the invention, and that in accordance with the prior art — see 20 — indicate that by avoiding a conical section, see 21, i.e., by harmonious application of the straightening and forging force, tolerance field 20 may be sharply reduced, as is evident from field 17. However, a short conical-zone-like section 19*a* still remains. However, as shown in the drawing, such section is of considerably less importance, when the relative dimensions of the conical section starting at edge 18*a* are considered. The conical-zone-like section of the workpiece extends around the periphery of the workpiece. Accordingly, a workpiece straightened in accordance with the present invention, either has less variation from the desired configuration, or section 21 projecting from the tolerance field is eliminated.

Figure 3:
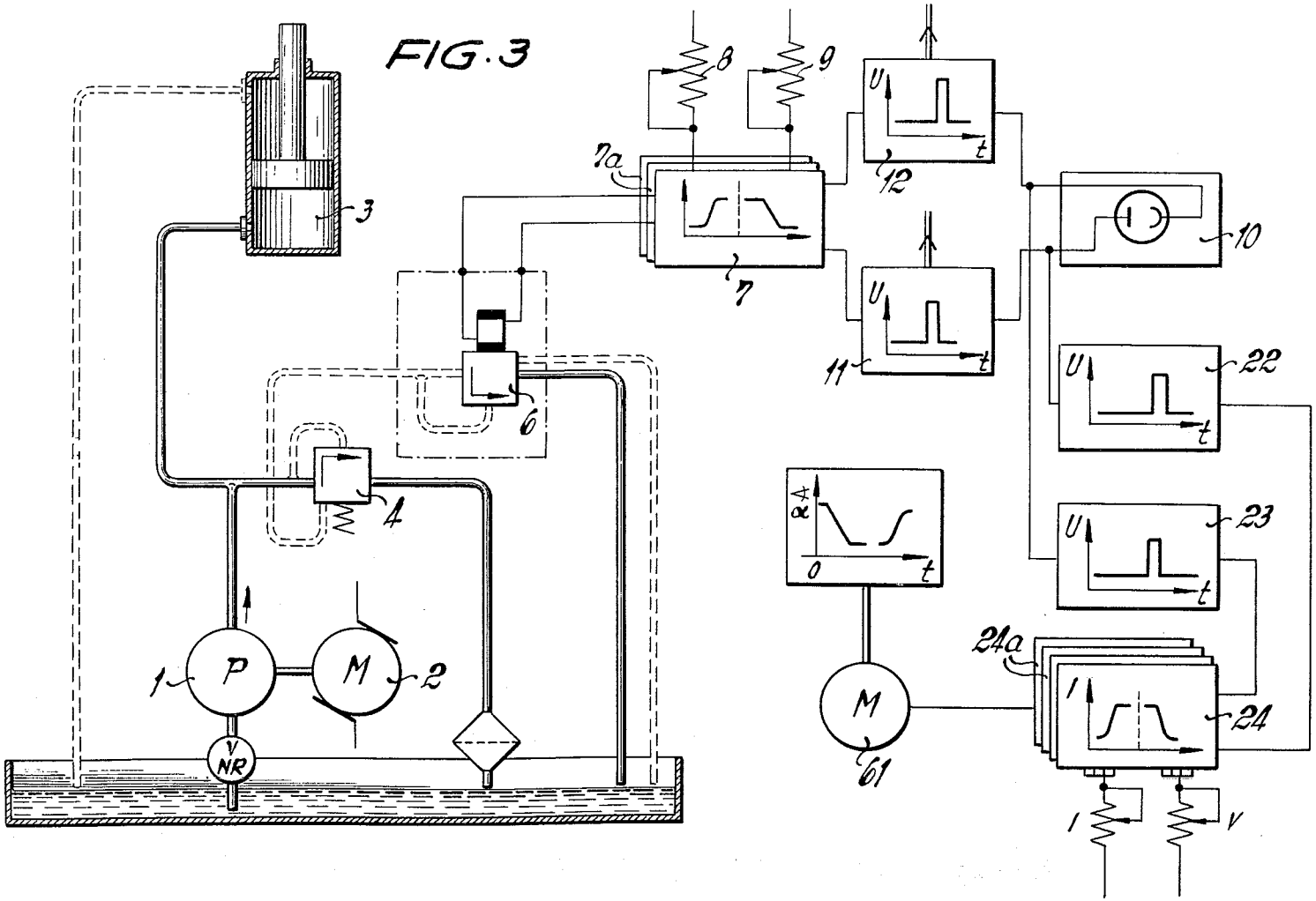
FIG. 3 is an illustration similar to FIG. 1 showing a separate control for the bending and forging force.

If the deviation or tolerance 17 from the norm is to be even closer, it is necessary to eliminate bulge 19*b* by separating the bending control still further from the control for the forging force. As shown in FIG. 3, the circuit diagram may be very similar to that in FIG. 1, however a parallel branch has been added. Thus two additional time switches 22, 23 are used, and these delay the pulse released by signal generator 10 for a longer period of time than time switches 11, 12, since the bending is carried out only after the forging force has been applied. In this case, the mathematical function is obtained from an electronic function-transmitter 24, which may be replaced by equivalent components 24*a* having other functions which are shown staggered behind component 24. By means of signals obtained from electronic function-transmitter 24, and thereafter converted by means not shown, a motor 61, preferably or direct-current, is controlled. This motor 61 may be used to adjust the angle of upper roll 15 during the straightening operation or while the workpiece is entering or leaving by conventional means, e.g., a worm gear drive, a V-belt drive, or an infinitely variable drive. The adjustment of the angle of the upper roll may, of course, also be carried out by hydraulic means.

In addition to linear and e-functions, it is possible to use as functions for electronic function-transmitter 24 sinusoidal curves, or similar functions having flat inlet and/or outlet phases.

Figure 4:
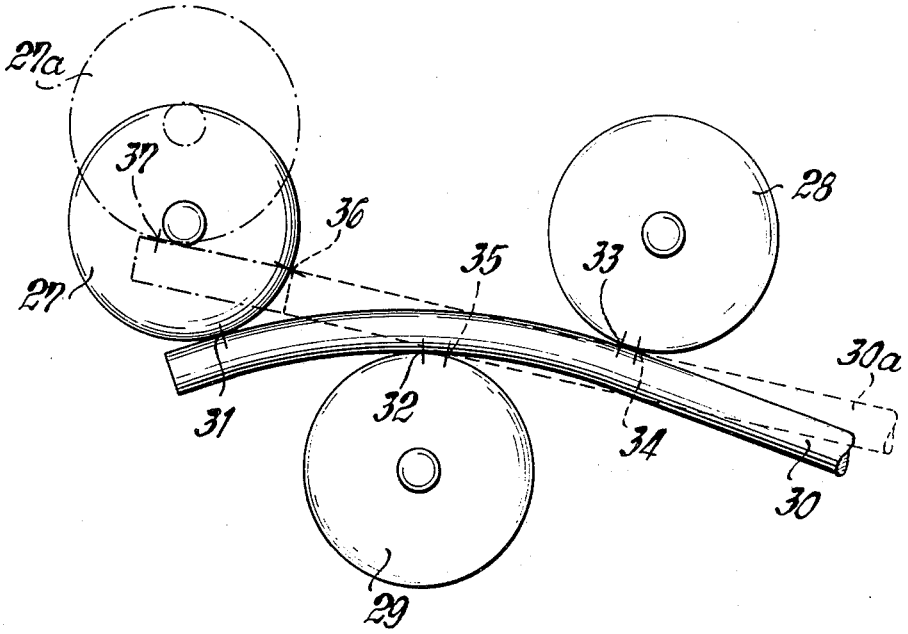
FIG. 4 is a schematic illustration of a segment of a workpiece entering between three rolls.

The FIG. 4 shows the front segment of a workpiece 30 bent between three rolls 27, 28, 29, the final bending triangle being formed by points 31, 32, 33. The entering workpiece 30*a*, shown in dotted lines, bears first against rolls 28, 29, at contact points 34, 35. The edge of the end face of the workpiece bears against roll 27. The point of contact 36 between roll 27 and the edge of the end-face of the entering workpiece forms the provisional bending triangle with contact point 35 on roll 29 and contact point 34 on roll 28. As workpiece 30*a* advances, contact point 36 travels, in a conventional mode for straightening, on the periphery of roll 27 until it reaches its final position at point 31. At the same time, contact point 34 of the entering workpiece travels, with roll 28, towards final contact point 33. Contact point 35 also moves towards subsequent final contact point 32. As a result of the unsatisfactory impingement of the facial edge of the workpiece 30*a* upon roll 27, the workpiece is deformed at that point. The deformation is prevented in accordance with this invention by providing that when the workpiece enters, roll 27 moves under spring bias or is withdrawn under control in an upward direction to position 27*a*, the straightening force in roll 27 being applied only when the forward section of the workpiece, shown in dotted lines, no longer forms, with the annular edge of its end-face, a third contact point 37 with the straightening roll, but forms this point with its peripheral surface. Rapid application of the straightening force in roll 27 bends the forward section of the workpiece in a downward direction, and contact point 37 moves towards contact point 31. When roll 27*a* has been fully lowered, the bending triangle for workpiece 30 reaches its final configuration with points 31, 32, 33. In principle, this procedure also takes place during free bending in a two-roll straightening machine.

Figure 5:
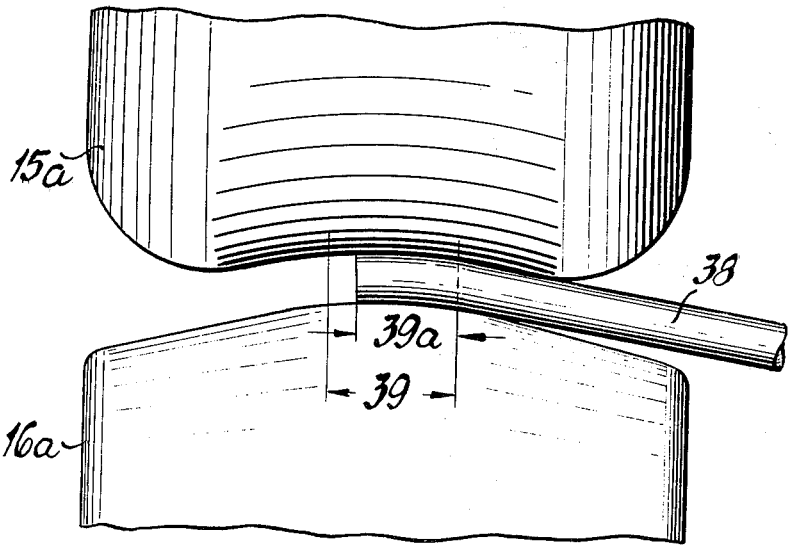
FIG. 5 is a view similar to FIG. 4, illustrating the rolls of a two-roll straightening machine and an entering workpiece.

In FIG. 5 there is shown part of a two-roll straightening machine with the lower part of a hyperbolic upper roll 15*a* and the upper part of a slightly convex lower roll 16*a*, and a section 39 of workpiece 38 between the two rolls. In the section 39, as defined by the arrows, the two peripherally opposite sides of the workpiece bear against two rolls 15*a*, 16*a*. Since the entering end 39*a* of workpiece 38 does not fully occupy stationary forging area 39, provision must be made, for the purpose of maintaining a constant surface pressure ($kp/cm^2$), for the force to be applied to the entering and outgoing section 39*a* of the workpiece which varies linearly between the maximal value and zero. For this reason, the pressure in cylinder 3 (see FIG. 1) must increase proportionally to compress length 39*a* of the workpiece. The forging force increases or decreases proportionally with the length 39*a* of the section of the workpiece already in the forging area.

Figure 6:
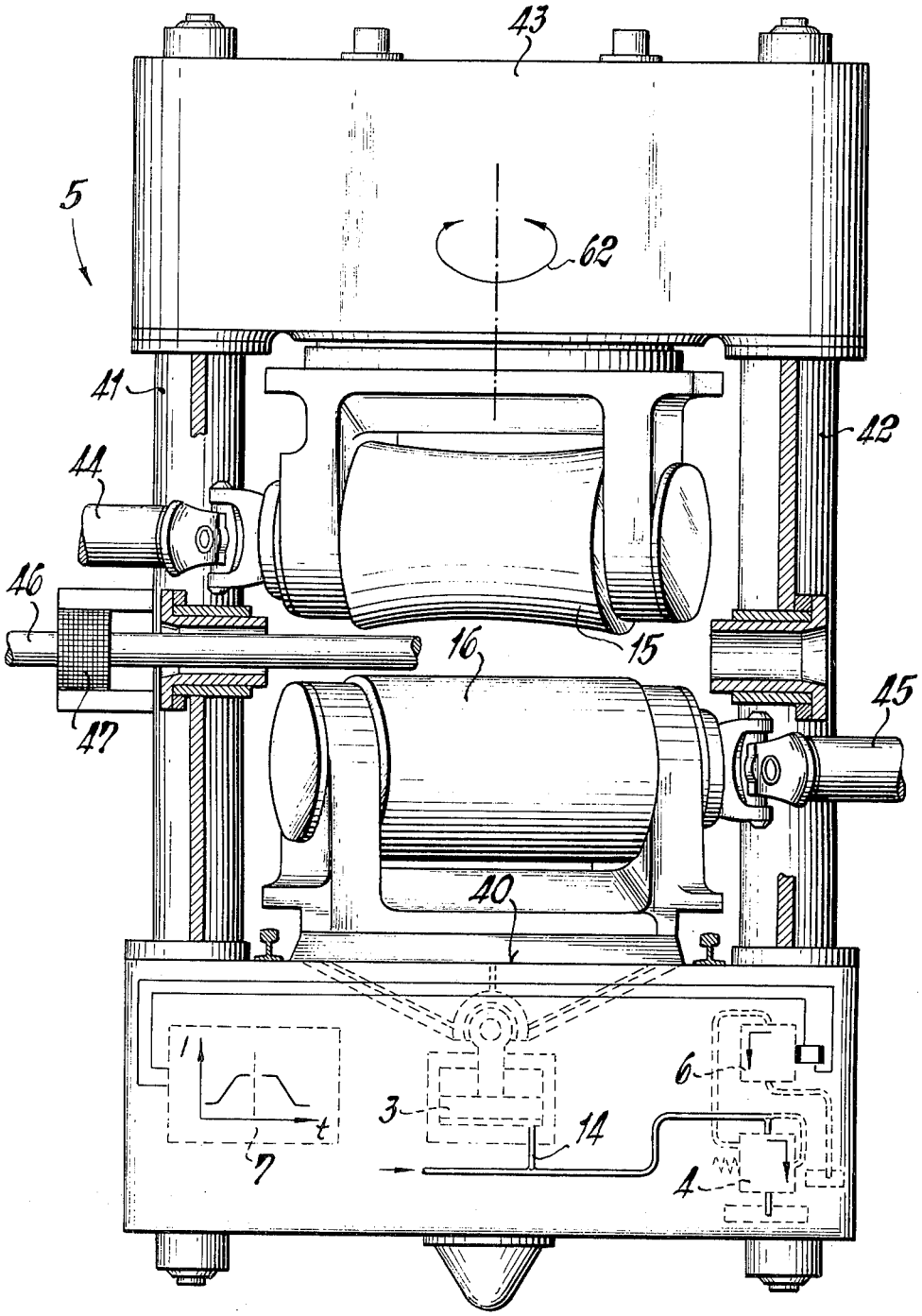
FIG. 6 is a vertical side view, generally schematic and partly in section showing a two-roll straightening machine in accordance with the present invention, provided with pre-selectable straightening forces and the bend being adjustable during the straightening operation.

FIG. 6 shows a two-roll straightening machine 5 having a table 40 with side members 41, 42 which for simplicity of illustration are shown in section, and a cross head 43. Located between cross head 43 and table 40 are driven upper roll 15 and driven lower roll 16, with their drive shafts 44, 45. A section 46 of the workpiece is introduced between rolls 15, 16 and extends through an induction coil 47 which is electrically connected to electronic control system 7. The induction coil 47 provides the delay signal for the application of the straightening force and the bending force. Shown diagrammatically below table 40 is a hydraulic overload-protection device comprising pre-controllable pressure-limit valve 4 and hydraulic cylinder 3. The lower roll 16 rests upon piston and cylinder 3. The remote-controlled pressure-limiting valve 6, controlled by electronic function-transmitter 7, permits the pressure in hydraulic line 14 to be raised or lowered. Since a hydraulic overload-protection device is in any case generally provided in any modern two-roll straightening machine, no additional means are required for adjusting the lower roll radially. The position of the upper roll is adjustable radially relative to the workpiece to alter the width of the straightening gap and rotatable in the direction of arrow 62. Adjustment of bending force is independent of that of the upper roll and can be accomplished during the straightening operation, especially when the workpiece is entering or leaving the machine. The conventional devices that are used for adjusting the angle between the longitudinal axis of the upper roll and the longitudinal axis of the workpiece are reinforced in such a manner to facilitate the adjustment of the angle of the upper roll during the straightening operation.

Figure 7:
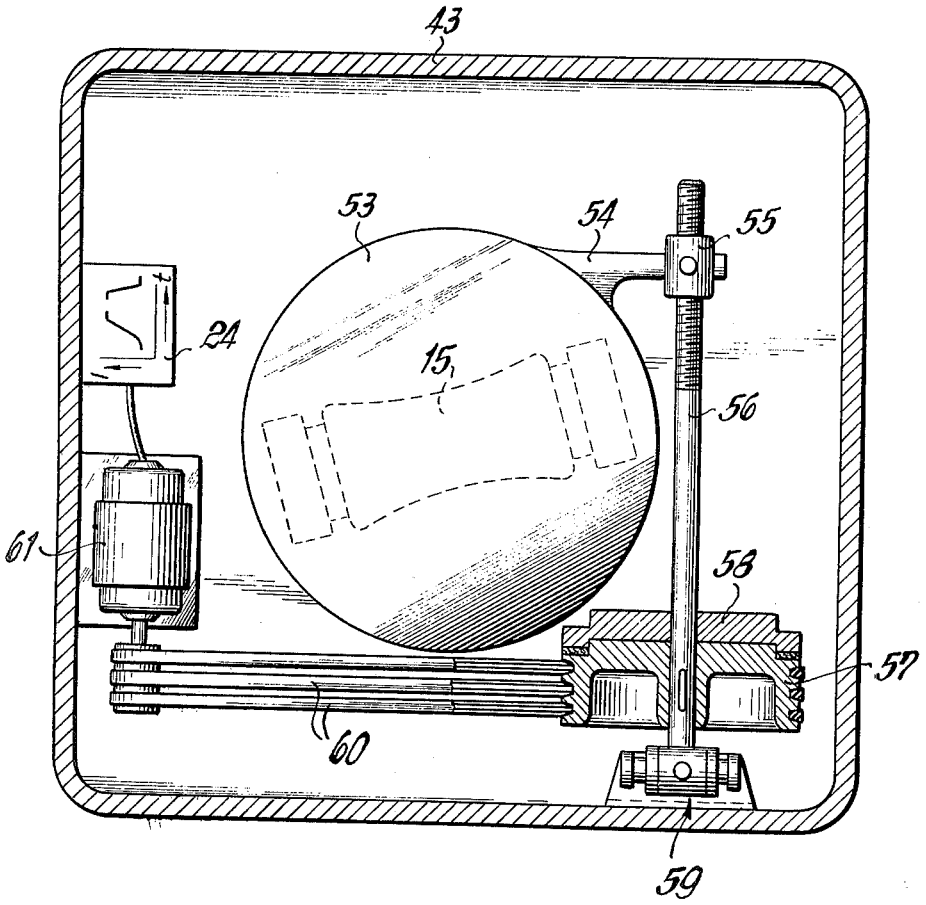
FIG. 7 is a plan view partly in section showing means for rotary adjustment of an upper-roll carrier.

The angular adjustment of the upper roll in a two-roll straightening machine is generally illustrated in FIG. 7. FIG. 6 shows in section a cross head or traverse 43 housing an upper roll carrier 53 for roll 15 and its adjusting mechanism. In this embodiment, the adjusting mechanism comprises an operating arm 54 projecting from upper-roll carrier 53. The arm terminates in a threaded nut 55 which is rotatably mounted on a threaded shaft 56 carrying in spaced relation a V-belt pulley 57. Also mounted on shaft 56 and abutting pulley 57 is a brake 58. The end of shaft 56 opposite to nut 55 is held in a bearing 59. The V-belt pulley 57 is driven by V-belts 60 from motor 61. The rotary speed of the shaft 56 need not be controlled by the motor 61 but a clutch and brake unit can also be utilized. However, the motor control together with the electronic control system 24, is preferred. When adjusting the height of upper roll 15 only carrier 53 is raised. The V-belt pulley 57 is hardly moved up or down, and the motor is stationary. When the height of upper roll 15 is adjusted, the shaft 56 becomes slightly inclined. However, such angularity of the shaft position is relatively unimportant when viewed in the context of the diameters of thw workpieces to be straightened in the machine. The shaft nut 55 allows the shaft 56 to rotate in all three dimensions in relation to arm 54. The shaft is also mounted rotatably in bearing 59 in three directions, to that it may follow the height as well as angular adjustments of upper-roll carrier 53.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

We claim:

1. A method for straightening sections of elongated workpieces, especially bars and tubes in a bending, forging and/or straightening machine having at least one straightening roll movable radially relative to the workpiece and at least a second roll for determining the straightening gap and force, comprising the steps of:

placing a section of a bar or tubing between the rolls;

moving one such roll into working position during the initial phase of straightening the forward section of the elongated workpiece in accordance with a predetermined mathematical work sequence function;

and straightening the intermediate section between the forward section and tail section of said workpiece by moving one roll into working position in a predetermined sequence which is independent of and substantially different from said work sequence for said forward and tail sections.

2. A method according to claim 1 for straightening sections of elongated material and having means for adjusting the bend in the bars or tubes, wherein said bend is adjusted during the straightening operation.

3. A method according to claim 2, and adjusting the forging force, with the adjustability of the bend being independent of the operation for adjusting the forging force.

4. A method according to claim 1, wherein the straightening force is related to the time required for the front or tail section of the workpiece to travel the distance between an initial signal station and a subsequent straightening station and at a given straightening speed.

5. A method according to claim 4, wherein during at least the initial phase of straightening a bar or tubing the workpiece assumes a bending triangle relative to the rolls, and during free bending the straightening force reaches its maximum rated value when said triangle has reached its final configuration.

6. A method according to claim 5, wherein the mathematical expression of the control sequence is sinusoidal in graphical form.

7. A method according to claim 1, wherein the preselectable mathematical sequence function establishes during forging that the surface pressure upon the tail section of the workpiece in the forging area of the machine remains constant.

8. A method according to claim 7, wherein the last mentioned sequence is a linear time-dependent value or function.

9. A method according to claim 7, wherein the last mentioned sequence is, substantially, an e-function.

10. In a metal working machine, particularly for workpieces such as bars and tubes, comprising: a group of straightening rolls, an electronic control system effective to control the movement of at least one roll of said group in accordance with a pre-selectable work sequence for the straightening force to be exerted against the forward and tail sections of the workpiece, and further including a separate work control sequence for controlling at least one roll between the forward and tail sections to effect the working of the intermediate section in a sequence different from said work sequence for said tail and forward sections, whereby there is imparted to the total lengths of the workpiece a substantially uniform geometric configuration.

11. A machine according to claim 10, and overload protection means comprising means for transferring control signals associated with one roll.

12. A machine according to claim 10, wherein said electronic control system is connected to a pressure limiting valve.

13. A machine according to claim 10, wherein said group includes a hyperbolic and a cylindrical or slightly convex roll, and means for rotatably moving at least said hyperbolic roll during the straightening operation about an axis at right angle to the workpiece and to its own longitudinal axis.

* * * * *